US006768802B1

(12) United States Patent
Baechler

(10) Patent No.: US 6,768,802 B1
(45) Date of Patent: Jul. 27, 2004

(54) BINAURAL SYNCHRONIZATION

(75) Inventor: Herbert Baechler, Meilen (CH)

(73) Assignee: Phonak AG, Stafa (CH)

( * ) Notice: Subject to any disclaimer, the term of this patent is extended or adjusted under 35 U.S.C. 154(b) by 0 days.

(21) Appl. No.: 09/431,702

(22) Filed: Nov. 1, 1999

(30) Foreign Application Priority Data

Oct. 15, 1999 (WO) ..... PCT/CH99/00488

(51) Int. Cl.[7] ..... H04R 25/00
(52) U.S. Cl. ..... 381/315; 381/312
(58) Field of Search ..... 381/231, 312, 381/314, 315, 320, 321, 323

(56) References Cited

U.S. PATENT DOCUMENTS 4,425,481 A 1/1984 Mansgold et al.
5,434,924 A * 7/1995 Jampolsky ..... 381/23.1
5,757,932 A 5/1998 Lindemann et al.

FOREIGN PATENT DOCUMENTS

EP 0 941 014 A2 9/1999
WO 98/16086 4/1998

OTHER PUBLICATIONS

WO 99/43185, Publication Date: Aug. 26, 1999, A Binaural Digital Hearing Aid System.

* cited by examiner

*Primary Examiner*—Huyen Le
(74) *Attorney, Agent, or Firm*—Pearne & Gordon LLP

(57) ABSTRACT

A device and method for operating binaural hearing aids each of which is switchable in situ in at least two transmission modes between a microphone assembly and an output converter. A wireless link is established between the hearing devices for communicating control signals between the hearing aids, and the control signals enable synchronization of the transmission modes at the devices to a predetermined or selectable mode-pair.

5 Claims, 2 Drawing Sheets

BINAURAL SYNCHRONIZATION

This invention relates to a procedure as specified in claim 1.

BACKGROUND OF THE INVENTION

In many cases, hearing impairment affects both ears so that both should be fitted with a hearing aid. So-called stereophonic or binaural hearing aids have been used in the past. More modern hearing-aid designs, typically equipped with at least two microphones, incorporate between these microphones and their output converter assembly, operating with an electromechanical converter, transmitter units in which the audio signal is processed and which can be operated in different, switchable transmission modes. For example, the audio-signal processing in one mode may be so tailored as to produce a relatively focussed audio-signal reception pattern while in the second mode a relatively nondirectional reception pattern is obtained, a third mode serves to squelch loud acoustic background noise, a fourth mode is particularly suitable for concert-hall use, etc. The switching from one transmission mode to another is done on the hearing aid itself, for instance by means of a toggle switch, with the user often being confused as to which of his two hearing aids is currently operating in which mode. One must consider that differentiating between the individual transmission modes in each of the two hearing aids is very difficult.

To solve this problem, a more recent approach in some cases has been to design remote control devices capable of controlling two hearing aids. To be sure, carrying and operating a remote control unit is not cherished by all users. A remote control, however, makes it possible to synchronize the transmission modes of both target hearing aids, for instance by only once pressing a single button that controls both hearing aids.

There also exist modern hearing aids which analyze the acoustic environment and on the basis of that analysis of the environment automatically make adjustments to obtain the optimal transmission mode. Where these devices are used binaurally, the mode adjustment for both hearing aids is often asynchronous since both units receive different audio patterns due for instance to head interference. Considering how quickly the acoustic environment and the head position can change, this may be irritating to the user.

BRIEF SUMMARY OF THE INVENTION

This invention is aimed at introducing a procedure of the type first mentioned, as well as a hearing-aid set with appropriate individual hearing aids, by means of which the aforementioned problems including especially the need for a remote control are eliminated while permitting the easy, automatic control of the transmission mode selection for binaural hearing aids. This is accomplished by employing the above-mentioned procedure with the characteristic features per claim 1.

By manually or automatically synchronizing the respectively enabled transmission modes of the hearing aids via a wireless connection between them—preferably a high-frequency connection—so as to be matched at a setpoint or selectable level, such synchronization can be obtained without a remote control unit for instance by pressing a button on one of the hearing aids or, along preset criteria described further below, by an automatic feature acting on both hearing aids, or by means of an added remote-control option.

In a first preferred implementation, the synchronization is established in a way that the two hearing aids, once synchronized, operate in the same active transmission modes. This can be accomplished by making one of the hearing aids the slave unit which adopts the respective mode of the other unit, the master. Which of the two hearing aids is the master can be predetermined, for instance the right-ear unit, but a situation-related changeover is possible for instance by selecting certain transmission modes as dominant modes which in the synchronization process determine the transmission mode of the other unit. For example, in automatic mode-enabling operation one of the hearing aids may be in a relatively infrequently used mode, such as the concert-hall setting, while the other unit may be operating in a standard mode. In that case, the synchronization will cause the hearing aid in the less frequently used transmission mode to connect to the hearing aid in the currently active standard mode and to adopt the latter.

It is also entirely possible in the case of hearing aids operating in different modes prior to synchronization to have such synchronization cause a switch to neither of these modes but to a third, common mode. This can be desirable when both hearing aids were in an infrequently used transmission mode, one for instance at the concert-hall level, the other at the loud-noise-squelching level. Upon synchronization, both hearing aids could thus be reactivated in the standard mode.

In another implementation of the procedure according to this invention, combinable in certain cases with the first procedure, synchronization causes each of the transmission modes to be switched to a different mode. This would be desirable in view of the ACTUAL pre-synchronization mode constellation which, empirically, is not made uniform but optimized. For example, if the pre-synchronization mode constellation involves two opposite modes, one being for instance at the concert-hall and the other at the loud-noise-squelching level, the synchronization could be so chosen as to adjust one unit for instance to the "slightly noisy environment" mode, the other to the standard mode, a post-synchronization constellation which, as experience has shown, will in most cases be a more satisfactory adjustment from the prior setting.

It is also entirely possible, in addition or as an alternative, to select the transmission modes enabled by synchronization based on an analysis of the currently prevailing or developing acoustic environment, in a way that for instance in the event of a strong change in the acoustic environment a synchronization process is triggered and the transmission modes are suitably adjusted. It is easy enough, for example in the case of a strongly increasing noise level which is registered primarily in one hearing aid, to enable an "increased attenuation" transmission mode in both hearing aids even though the second unit may not as yet have registered the augmented level due for instance to temporary head interference.

The synchronization itself can be triggered either manually on one of the hearing aids, or via remote control and/or through the result of an analysis of the current acoustic environment and/or through specific mode constellations which at least over an extended period have not been empirically determined as being optimized.

By virtue of the fact that there is a wireless communication link between the two hearing aids whereby merely a control signal for the selection unit is sent from one hearing aid to the other, it is possible to establish a binaural balance between the hearing aids without the need to transmit complex audio processing signals between the hearing aids with a substantial attendant increase in energy consumption.

For the synchronization as intended by this invention it suffices to transmit a few bits, identifying the desired transmission mode, with a long repetition rate from a few seconds to several minutes, which puts virtually no load on the power consumption. Moreover, it follows a short, mechanically most stable transfer path between the ears of the user, which also provides high immunity to RF interference.

The following describes this invention by way of examples with the aid of drawings in which:

DETAILED DESCRIPTION OF THE INVENTION

Figure 1:
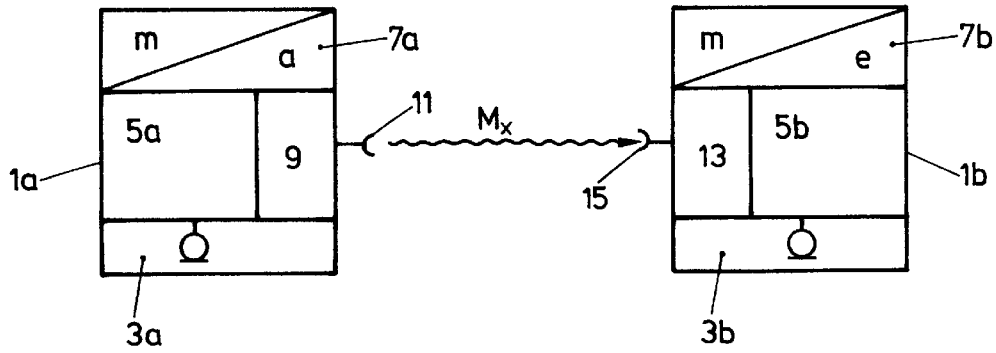
FIG. 1 schematically illustrates the principle of the procedure, the set of hearing aids and the corresponding individual hearing aids, each according to this invention.

By way of a schematic diagram of a set of two hearing aids according to this invention, FIG. 1 shows the underlying principle of the invention.

The two hearing aids 1*a* and 1*b* can be individually switch in situ, in different transmission modes relative to their transfer pattern between the input end of the microphone assembly 3*a*, 3*b*, to their electro-mechanical output converter systems 7*a*, 7*b* by way of the corresponding signal processing units 5*a*, 5*b*. At least one of the two hearing aids, 3*a*, is provided with a transmitter 9 and a transmitter antenna 11 for instance in the form of an inductance coil. At least the other hearing aid, 3*b*, is equipped with a receiver 13 and a receiver antenna again for instance in the form of an inductance coil. The transmitters/receivers 9 and 13, respectively, are preferably designed for high-frequency signal transmission, preferably within a frequency range from 100 kHz to 1 MHz. By way of the transmission/reception path 9/13 of the two hearing aids 1*a*, 1*b*, the transmission modes of the two hearing aids are mutually balanced, i.e. synchronized, by manual intervention and/or by automatic triggering, as will be described further below. In essence, this is accomplished by sending only transmission-mode identifiers, requiring just a few bits at low repetition rates. In the simplest case, illustrated in FIG. 1, the transmitting hearing aid 3*a* sends the identifier $M_x$, for its currently active transmission mode $M_x$, to the receiving hearing aid 3*b* which now changes its own transmission mode over to Mode $M_x$.

In this simple configuration per FIG. 1, one of the two hearing aids, 3*a*, thus serves as the master, the other, 3*b*, as the slave which adopts the transmission mode of the master hearing aid.

However, as explained further above, the mode synchronization in its enhanced form may also be implemented in such fashion that both hearing aids are synchronized to one identical transmission mode which differs from the mode active in either unit at the time of the synchronization.

It is also entirely possible at the time of synchronization to tune the hearing aids to different transmission modes, either one or none of which corresponds to the transmission mode active prior to the synchronization.

The modes enabled by the synchronization, especially in the case of automatic triggering of the synchronization, may reflect:

- modes activated prior to the triggering and representing optimum empirical modes and/or
- the acoustic environment or any changes thereof,
- apart, in the simplest case, from uniformly matched modes.

The synchronization process proper may be triggered manually either on one of the two hearing aids or via a remote-control option for the hearing aids, or it can be triggered automatically, at preset time intervals and/or upon the incidence of empirically established unfavorable mode constellations in both hearing aids and/or of certain acoustic-environment conditions or changes thereof.

Notwithstanding the fact that this description will already open up to the expert a large number of possible forms of implementation of this invention, the following will serve to illustrate in schematic fashion additional implementation examples with the aid of signal-flow/function-block diagrams.

This is based on the premise that in most cases the hearing aids according to this invention are identical in design and that, whenever within the scope of the synchronization according to this invention the two hearing aids are to perform different functions, for instance along the master-and-slave concept mentioned, appropriate programming will control the activation and deactivation of these functions.

Figure 2:
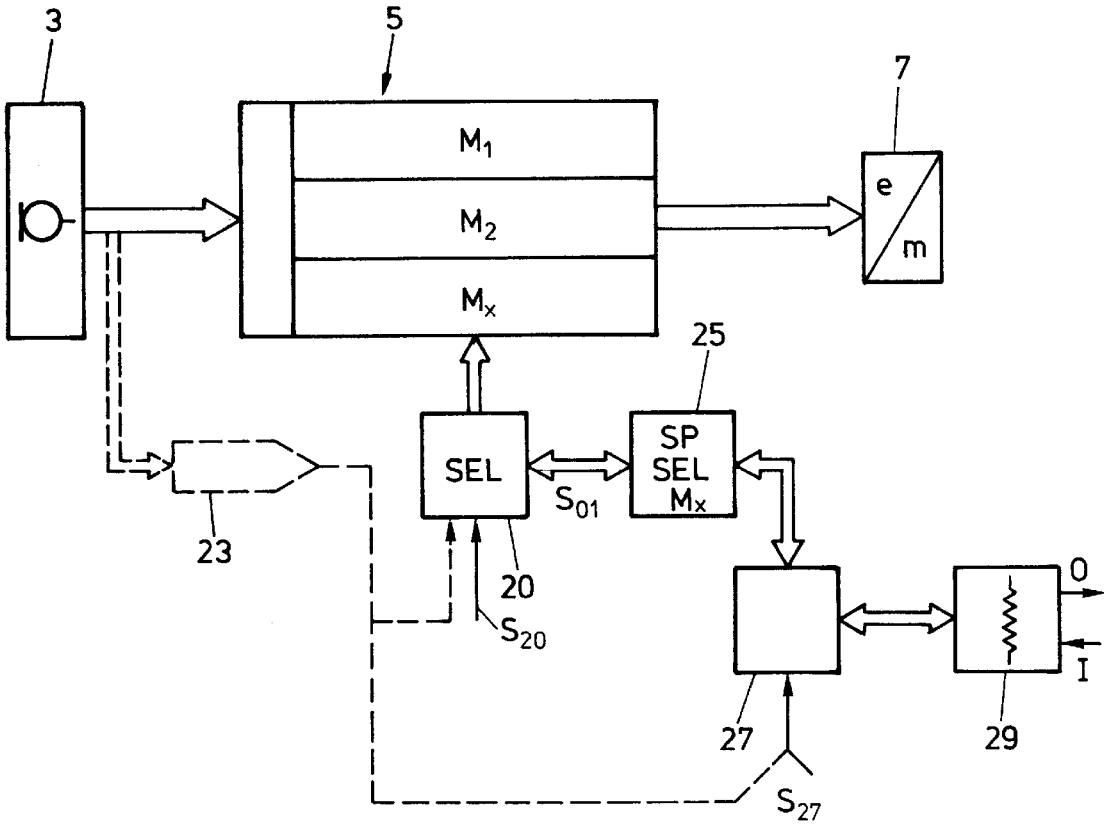
FIG. 2 schematically illustrates an individual hearing aid of a set of hearing aids according to this invention in the form of a simplified signal-flow/functional block diagram.

The function-block/signal-flow diagram in FIG. 2 represents two identical individual hearing aids of a hearing-aid set according to this invention. Function blocks shown in FIG. 1 bear the same reference numbers in FIG. 2. The microphone system 3 connects to the converter 7 via the signal processing unit 5. A selector switch 20 on the signal processing unit 5 permits the selection of at least two and preferably several transmission modes $M_1$, $M_2$ . . . $M_x$.

The transmission mode M currently to be enabled is manually selected on the selector switch assembly 20, shown in position $S_{20}$, for instance by means of a toggle switch on the hearing aid or, wireless, via the remote control. In adaptation to the current acoustic environment, it is equally possible, as indicated by the dotted outline, to select the transmission mode M that is best for each prevailing acoustic-environment condition, by means of an evaluation unit 23 and the selector switch 20 on the hearing aid.

By way of example and as illustrated, the selector switch assembly 20 is provided with an identifier memory 25 in which the corresponding identifier $M_x$ of the currently active transmission mode M is stored. The identifier memory 25 connects to a transmission/reception controller 27 with a transmitter/receiver assembly 29. When a second hearing aid, preferably identical in design to the one in FIG. 2, is to be synchronized, and assuming that the hearing aid shown in FIG. 2 is the master, the transmission/reception controller 27 will be triggered as indicated by $S_{27}$ and will send the mode identifier $M_x$, stored in the identifier memory 25, to the other hearing aid via the transmitter/receiver 29 which now acts as the transmitter -O-. The other hearing aid receives the identifier $M_x$, its transmission/reception controller 27 stores it in its own identifier memory 25, whereby, as indicated by the bidirectional path $S_{01}$, the selector switch assembly 20 is set according to the mode identifier received. The receiving hearing aid, i.e. the slave, now operates in the same transmission mode $M_x$ as the transmitting hearing aid, that being the master.

By activating or deactivating the signal input $S_{27}$ which triggers this synchronization process, one can specify which of the two hearing aids is to operate as the master and which as the slave.

As stated, the synchronization process in the master hearing aid can be triggered manually via $S_{27}$, or automatically. If, as indicated by the dotted outline in FIG. 2, the evaluation unit 23, upon an analysis of the current acoustic environment, automatically causes a mode change in the hearing aid concerned by way of the selector switch assembly 20, a synchronizing process can be automatically triggered via the control input $S_{27}$ either simultaneously or at a predetermined time interval. Of course, it is also possible (but not illustrated) to apply the synchronization trigger signal in the master hearing aid at the input $S_{27}$ by means of a timer operating at preset time intervals.

Once the master and slave functions have been established, this master/slave approach requires only one-way communication between the hearing aids.

Figure 3:
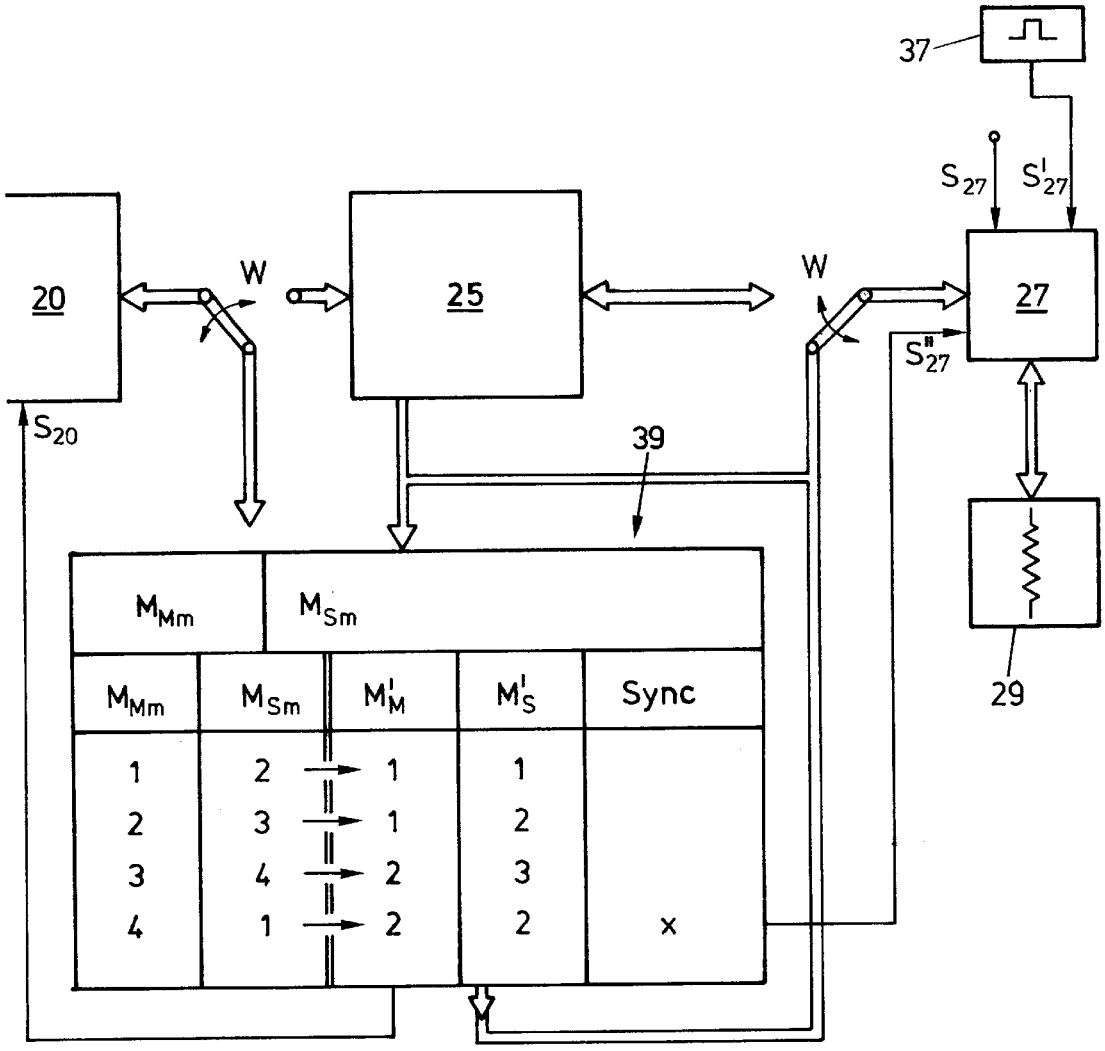
FIG. 3 is an illustration, analogous to FIG. 2, of an enhanced design version of a hearing aid according to this invention, as part of a two-piece set according to this invention and operating under utilization of the procedure according to this invention.

Building on the concept illustrated in FIG. 2 and essentially following the master/slave principle, FIG. 3 shows how at the point of synchronization the transmission mode of the master hearing aid need not be simply accepted but, instead, by employing for instance $M'_M$, $M'_S$, an optimal constellation is selected on the basis of the current constellation of both transmission modes $M_{Mm}$ and $M_{Sm}$.

FIG. 3 only shows the function blocks and signal paths which differ from those of the hearing aid in FIG. 2. Connected to the transmitter/receiver 27 is a timer 37 which, activated in only one hearing aid and operating at preset time intervals, sends the currently enabled transmission mode $M_{Sm}$ from the identifier memory 25 activated by this unit to the other unit. In contrast thereto, as schematically indicated by the switches W, a table memory 39 is activated in the other hearing aid, the master. The mode identifier $M_{Sm}$, sent by the slave in response to the transmission clock pulse of the timer 37, is stored in the table memory 39, as is the mode enabled by the currently valid identifier $M_{Mm}$ of the master. When, as described in reference to FIG. 2, the control signal $S_{27}$ triggers a synchronization, whether manually or automatically, a constellation $M'_M/M'_s$ which has been found to be optimal for the current constellation $M_{Mm}/M_{Sm}$ is retrieved from the table in the table memory 39, $M'_M$ and applied to the selector input $S_{20}$ and $M'_S$ is sent to the master for storage in the identifier memory 25 and for activating the corresponding mode.

As indicated in FIG. 3, synchronization can also be triggered automatically by the presence of preselected mode constellations, in addition to or in lieu of the automatic triggering on the basis of an analysis of the acoustic environment as shown in FIG. 2, or to/of manual actuation. In FIG. 3, the constellation $M_{Mm}=4$, $M_{Sm}=1$ triggers a synchronization process at $S''_{27}$, the result being $M'_M=2$ and $M'_S=2$.

If both devices are configured identically, it is easy by virtue of the two constellations $M_{Mm}$, $M_{Sm}$ to decide which hearing aid or which mode of the constellation is dominant, permitting instantaneous automatic assignment of the master/slave function. For example, mode 2 can be selected to dominate all others, 1, 3, 4, while 3 dominates modes 1 and 4. The device which is currently operating in the dominating mode will retain its mode or will adopt the master configuration described in reference to FIG. 3.

Moreover, the result of the acoustic-environt analysis, obtained by means of unit 23 in FIG. 2, can be employed in addition to or perhaps in lieu of the instantaneous constellation $M_{Mm}/M_{Sm}$ for establishing the constellation $M'_M$, $M'_S$ to be created upon synchronization. As a consequence, the table in the table memory 39 will take on another dimension or the characteristic value of the acoustic-environment evaluation will appear in the table instead of the instantaneous constellation $M_{Mm}/M_{Sm}$.

The method according to this invention makes it possible, with minimal additional electric power consumption, to mutually optimize the binaurally used hearing aids for the mode-identifier transmission at relatively large time intervals. The user is able at any time to manually and especially by way of the remote control break through the established synchronization; based on the operating principle of this invention as described, the synchronization can be restored or reestablished, a process which in the case of automatic restoration can be disabled by the user.

What is claimed is:

1. A method for operating binaural hearing devices, each of said devices being switchable in situ in at least two transmission modes (Mx) between a microphone arrangement and an output converter, comprising the steps of:

establishing a wireless communication link between the devices exclusively for transmitting control signals between the devices, wherein said control signals include signals for synchronizing the transmission modes of the devices; and synchronizing the respectively activated transmission modes of the devices by means of the control signals to a preset or preselectable mode-pair.

2. The method as in claim 1, wherein the synchronization is made to identical transmission modes, either to one which was an active mode prior to the synchronization, or to a common third mode.

3. The method as in claim 1, wherein the synchronization of transmission modes performed is a function of an existing mode constellation (Mmm/Msm) and/or of the acoustic environment and predetermined optimal mode constellations (M'm/M's).

4. The method as in claim 1, wherein the synchronization is automatically triggered on the basis of the current acoustic environment and/or of a momentary constellation (Mmm, Msm) of the activated transmission modes.

5. The method as in one of claims 1 to 4, wherein one of the hearing devices is preselected as a hearing device controlling the synchronization, or one of the hearing devices is automatically selected as a leading device on the basis of its current mode and/or as a function of the acoustic environment.

* * * * *